US006094866A

United States Patent [19]

Busnelli

[11] Patent Number: 6,094,866

[45] Date of Patent: Aug. 1, 2000

[54] SYSTEM FOR OPENING AND CLOSING DOORS IN FURNITURE, ROOMS AND THE LIKE

[75] Inventor: Giorgio Busnelli, Cabiate, Italy

[73] Assignee: B & B Italia S.p.A., Italy

[21] Appl. No.: 09/038,997

[22] Filed: Mar. 10, 1998

[30] Foreign Application Priority Data

Dec. 3, 1997 [EP] European Pat. Off. ..... 97830117

[51] Int. Cl.[7] ..... E05D 15/10

[52] U.S. Cl. ..... 49/219; 49/211; 49/216

[58] Field of Search ..... 49/211, 216, 218, 49/219, 221, 223, 125, 207, 127–130; 312/322, 323, 319.4, 319.1, 324

[56] References Cited

U.S. PATENT DOCUMENTS

| | | | |
|---|---|---|---|
| 3,132,884 | 5/1964 | Ahlgren | 49/209 |
| 3,810,330 | 5/1974 | Daggy | 49/127 |
| 4,157,846 | 6/1979 | Whitcroft | 49/209 X |
| 4,384,429 | 5/1983 | Rokicki et al. | 49/130 |

FOREIGN PATENT DOCUMENTS

| | | |
|---|---|---|
| 0 712 989 | 5/1996 | European Pat. Off. . |
| 0 219 219 | 4/1997 | European Pat. Off. . |
| 29 32 730 | 4/1980 | Germany . |

*Primary Examiner*—Daniel P. Stodola
*Assistant Examiner*—Hugh B. Thompson
*Attorney, Agent, or Firm*—Jeffer, Mangels, Butler, & Marmaro LLP

[57] ABSTRACT

A system for opening and closing at least one door in furniture, rooms and the like, involves the use of a vertical rod from which arms extend that engage slidingly with the door, the bottom of the door being fitted with wheels so that, in order to open the door and by rotating the arms, the door is moved from the closed position into a position in which it is displaced outwards. The door is then slid back over the arms until the opened position is reached. This door opening and closing system does not require any space in front of the door and, in cases where there are multiple doors, allows one door to be in perfect alignment with another door. Furthermore, it is both structurally simple and easy to operate.

20 Claims, 7 Drawing Sheets

M
20
22
24
37
42
43
46
48
49
51
53
55

SYSTEM FOR OPENING AND CLOSING DOORS IN FURNITURE, ROOMS AND THE LIKE

BACKGROUND OF THE INVENTION

The present invention relates to a system for opening and closing doors in furniture, rooms and the like.

As is known, the classic and most basic system of opening and closing doors using hinges, and the more complex system of opening and closing folding doors, both require a certain amount of space in front of the doors in order to allow them to open.

There is an alternative opening system using sliding doors which does not require any space in front of the doors. In this ease the doors run on mutually parallel tracks. They are not, therefore, in alignment with each other and this means that they take up more space, are unattractive from an aesthetic point of view and are not completely dust-proof.

In order to satisfy the need to have doors that are aligned in the closed position and yet do not take up any space as they are opened, a system also exists in which the doors are in fact aligned in the closed position and each door is opened by moving it in a direction perpendicular to the plane of alignment of the doors and then sliding it along a plane parallel with this plane of alignment. The doors are, of course, closed by carrying out these movements in reverse.

The latter system requires the use of carriages, tracks, pulleys and cords to move each door in the abovementioned perpendicular direction, as well as an upper and lower track, together with associated rollers, to slide each door sideways; there is also a lower sliding track which is common to the doors; and, lastly, a device must also be provided for immobilizing the lower track of the door when the latter is pulled outwards before it is slid sideways.

This system is certainly efficient, but it is also rather complex in terms of its mechanics, and this increases production costs as well as reducing its reliability over time.

SUMMARY OF THE INVENTION

The object of the present invention is to provide a door opening and closing system that is able to satisfy the abovementioned requirements and at the same time is simple to build and easy to operate.

This object is achieved by means of a system for opening and closing doors in furniture, rooms and the like, in which there is at least one door that is moved between a closed position and an opened position, comprising a vertical rod inside the piece of furniture or room, from which rod integral arms extend that can rotate about the axis of the rod, the ends of these arms carrying elements that engage slidingly with horizontal tracks on the door, wherein the bottom of the door has rolling elements in contact with the bottom of the piece of furniture or the floor of the room, wherein, by rotating the arms, the door can be moved from the closed position into a position in which it is displaced outwards and wherein the door can be moved horizontally by sliding the tracks over the engagement elements and by rolling the rolling elements along the bottom until the opened position is reached.

BRIEF DESCRIPTION OF THE DRAWINGS

In order to give a clearer explanation of the invention, a description is given below of a non-limiting embodiment thereof, illustrated in the appended drawings in which.

DETAILED DESCRIPTION OF THE PREFERRED EMBODIMENT

Figure 1:
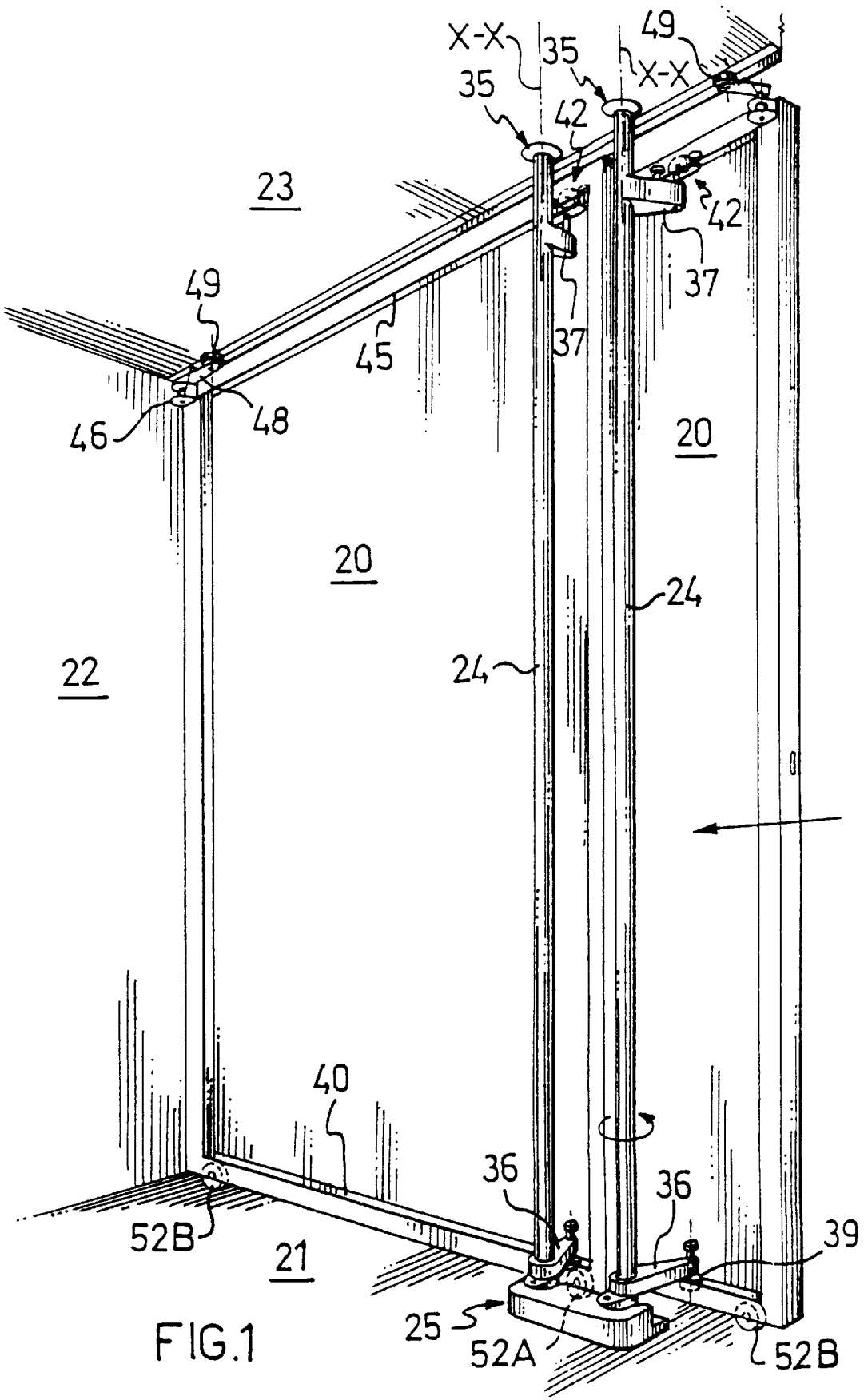
FIG. 1 shows a perspective view of a system for opening and closing two doors in accordance with the invention.

The door opening and closing system illustrated here is fitted to a wardrobe. The doors, which in this example are two in number, are denoted by the reference 20; as for the wardrobe, the bottom is denoted 21, the side walls 22 and the ceiling 23.

This door opening and closing system comprises a pair of vertical rods 24 having a circular cross-section which are located close to each other inside the wardrobe, symmetrically on either side of the vertical median joining plane of the two doors 20, denoted M in FIGS. 7 to 12.

Figure 2:
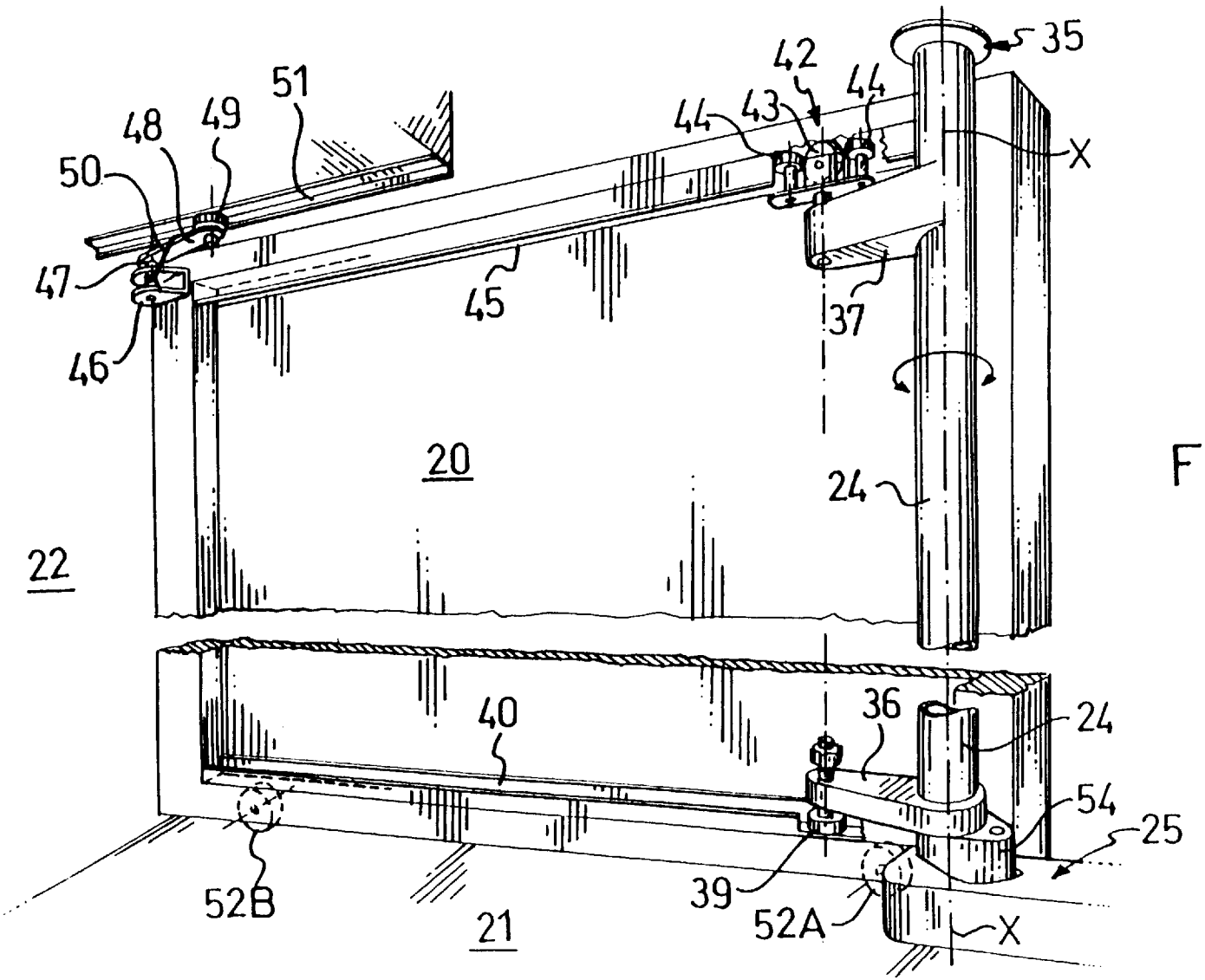
FIG. 2 shows, in greater detail than FIG. 1, the system for opening and closing one of the two doors.
Figure 3:
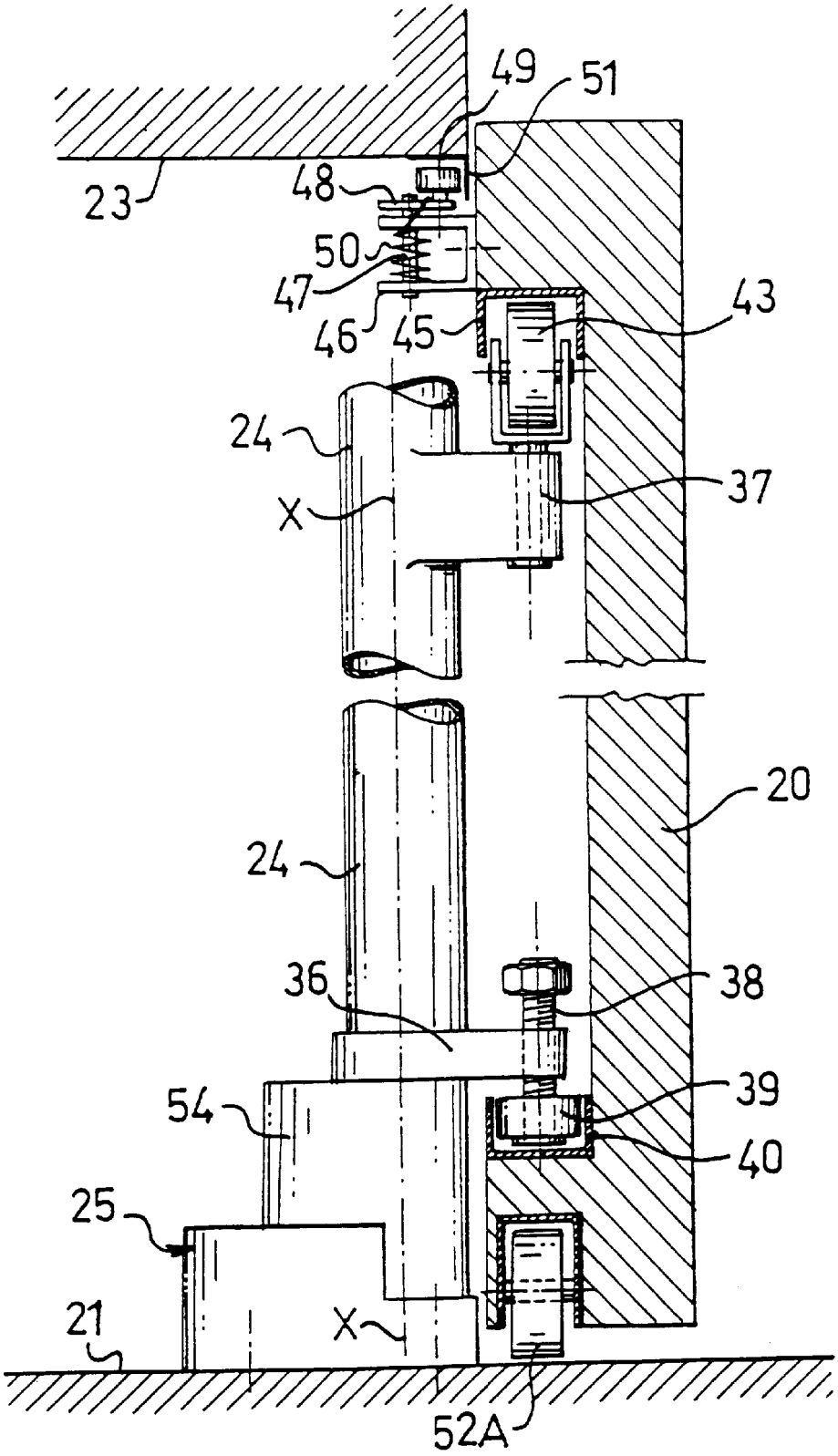
FIG. 3 shows an enlarged cross-section of FIG. 2.
Figure 4:
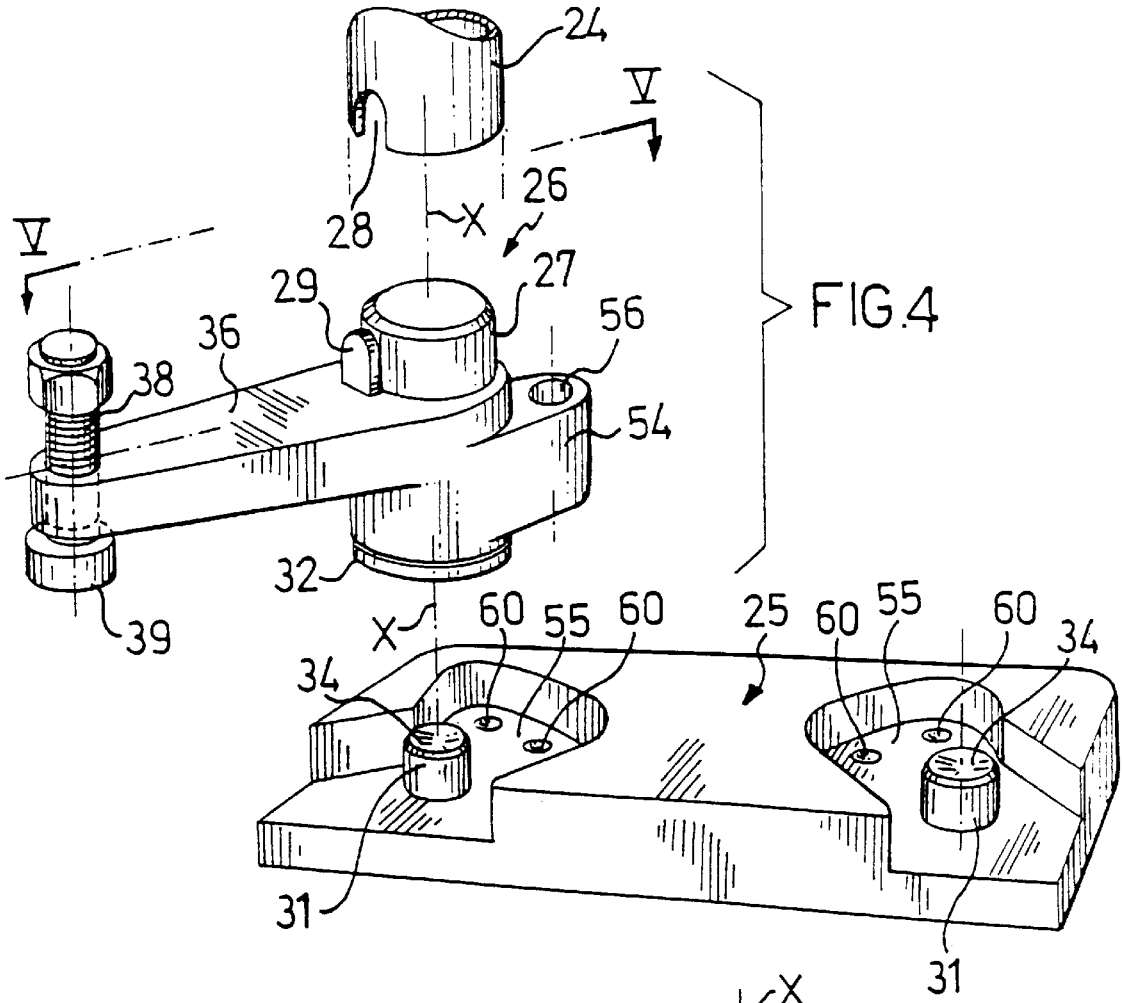
FIG. 4 shows an enlarged and exploded perspective view of a detail of the opening and closing system shown in FIG. 1.
Figure 5:
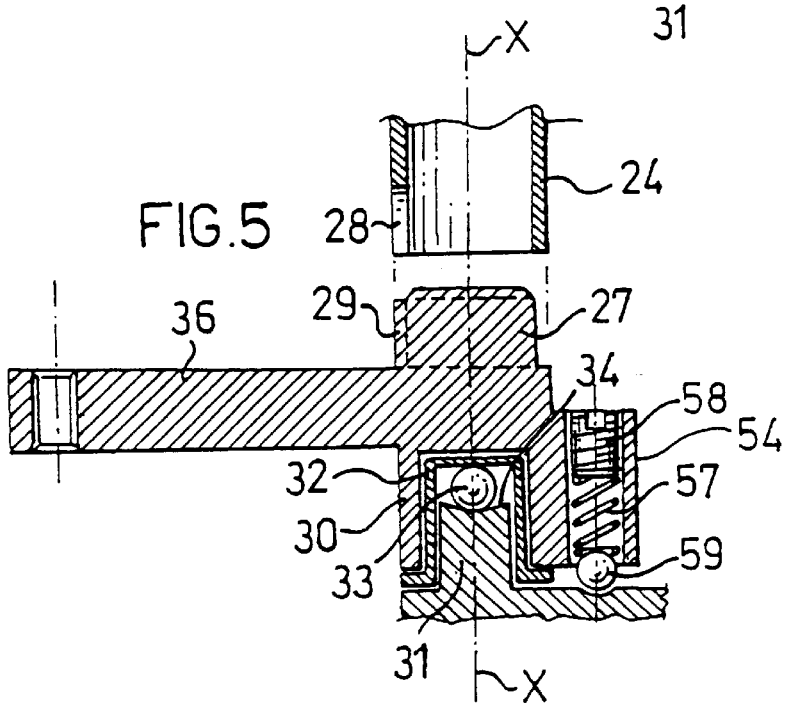
FIG. 5 shows a cross-section, on the plane V—V, of the detail shown in FIG. 4, partly assembled.
Figure 6:
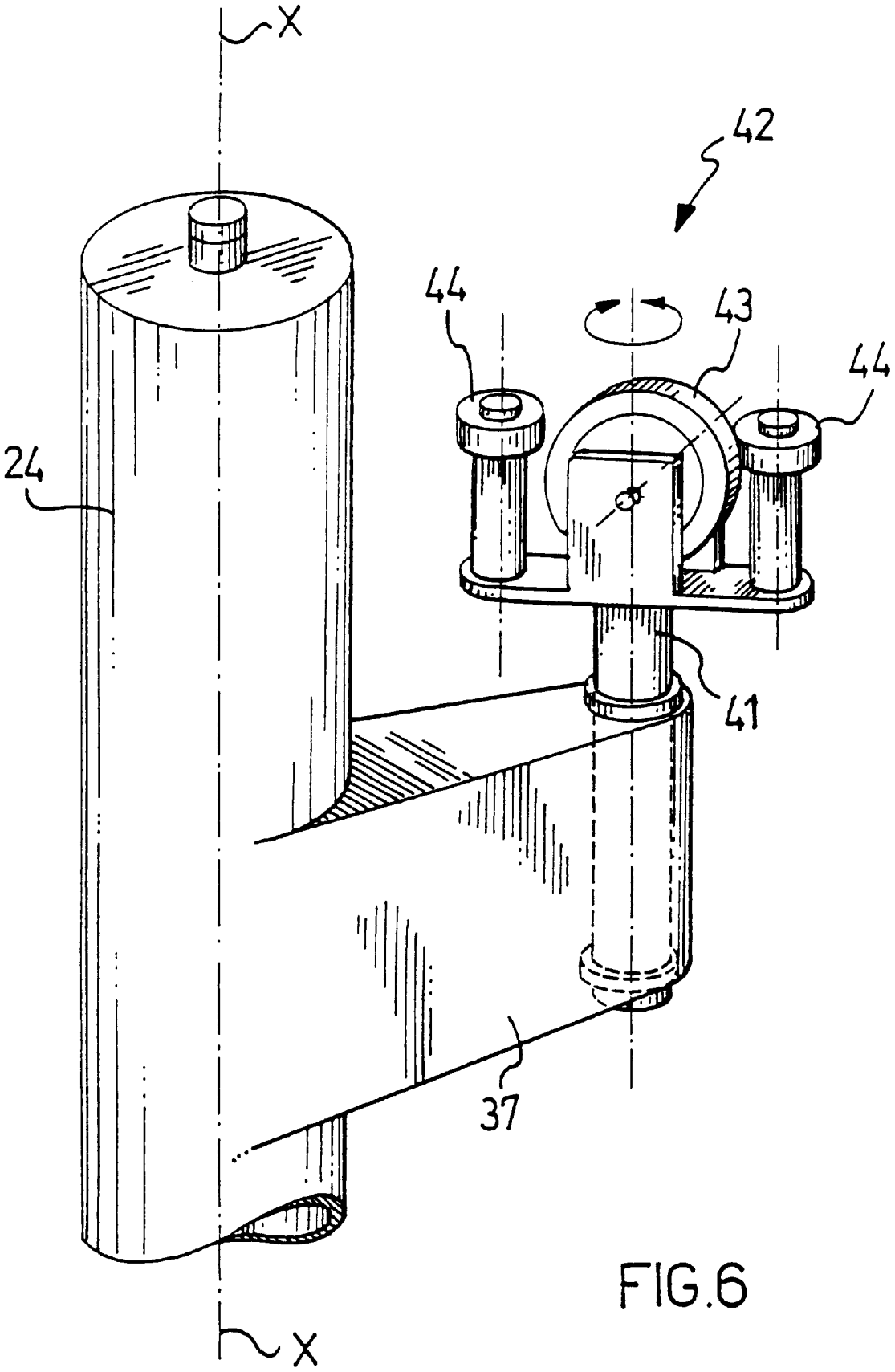
FIG. 6 shows an enlarged perspective view of another detail of the opening and closing system shown in FIG. 1.

The two vertical rods 24 are mounted so that they can rotate freely about their own axes X on a base 25 fixed to the bottom 21 of the wardrobe. More specifically, and with reference to FIGS. 4 and 5, each rod 24 is provided with a block 26 having a cylindrical upper part 27 that forms a male and female joint with the rod and is locked in rotation thereto by a notch 28 formed ithe bottom end of the rod, this notch fitting over a projection 29 on the said cylindrical part 27. The block 26 also has a lower cylindrical part 30 that is rotatably coupled to a pin 31 via the interposition of a bush 32 and a ball 33, the latter being accommodated in a cavity 34 in the top of the pin. The top of each rod 24 (FIGS. 1 and 2) is attached to the ceiling 23 of the wardrobe by means of a simple pivot, denoted overall by the reference 35.

A lower arm 36 and an upper arm 37 extend from each rod 24. More specifically, the lower arm 36 extends integrally from the block 26, while the upper arm 37 extends integrally from the rod 24 itself.

The end of each lower arm 36 carries a screw 38 that screws vertically into a threaded hole in the said arm. A roller 39 having a vertical axis is mounted so as to rotate freely on the end of the shank of the screw 38, is underneath the arm 36, the said roller being accommodated in a U-shaped horizontal lower track 40 found on the associated door 20 and extending across almost the full width of the said door.

The end of each upper arm 37, on the other hand, carries a pin 41 that can rotate freely on the said arm. Mounted on the pin 41 is a carriage 42 comprising a freely rotating wheel 43 having a horizontal axis and two freely rotating rollers 44 each having a vertical axis and located on either side of the wheel 43. Both the wheel 43 and the rollers 44 are accommodated in an inverted-U-shaped horizontal upper track 45 found on the associated door 20 and extending across almost the full width of the said door, parallel with the lower track 40.

A bracket 46, into which a vertical pin 47 is rotatably inserted, is fixed to the upper part of each door 20, on the opposite side to the side that meets the other door. Fixed to the top of the pin 47 is the end of a lever 48 whose other end carries a freely rotating roller 49 having a vertical axis. A torsion spring 50 acts on the lever 48 and keeps the roller 49 pressed elastically against an "L"-shaped track 51 which is fixed to the ceiling 23 of the wardrobe and runs horizontally across the full width of the wardrobe.

The bottom of each door 20 is fitted with two wheels located symmetrically on either side of the centre line of the door; one wheel, denoted 52A, is located close to the side that meets the other door, while the other wheel, denoted 52B, is on the opposite side.

The aligned position of the doors 20 is defined by the latter stopping against the base 25 at the bottom, against indentations 53 in the side walls 22 at the sides, and against the track 51 at the top.

Each block 26 has a projecting portion 54 which is accommodated in a recess 55 formed in the base 25. The dimensions of this recess are such that they allow the portion 54 to execute an angular movement of predetermined amplitude only, thereby limiting the rotation of the block 26. Formed in the projecting portion is a hole 56 which accommodates a spring 57, one end of which abuts against a screw 58, screwed into the hole 56, and the other end of which acts on a ball 59. Two hemispherical hollows 60 are formed in the base 25, the ball 59 being inserted in one or other of these hollows when the portion 54 of the block 26 is in one or other of two angular positions respectively.

A handle 61 is formed half-way up each door, near the side that meets the other door.

The door opening and closing system described and illustrated here works in the following way.

Figures 7, 8, 9:
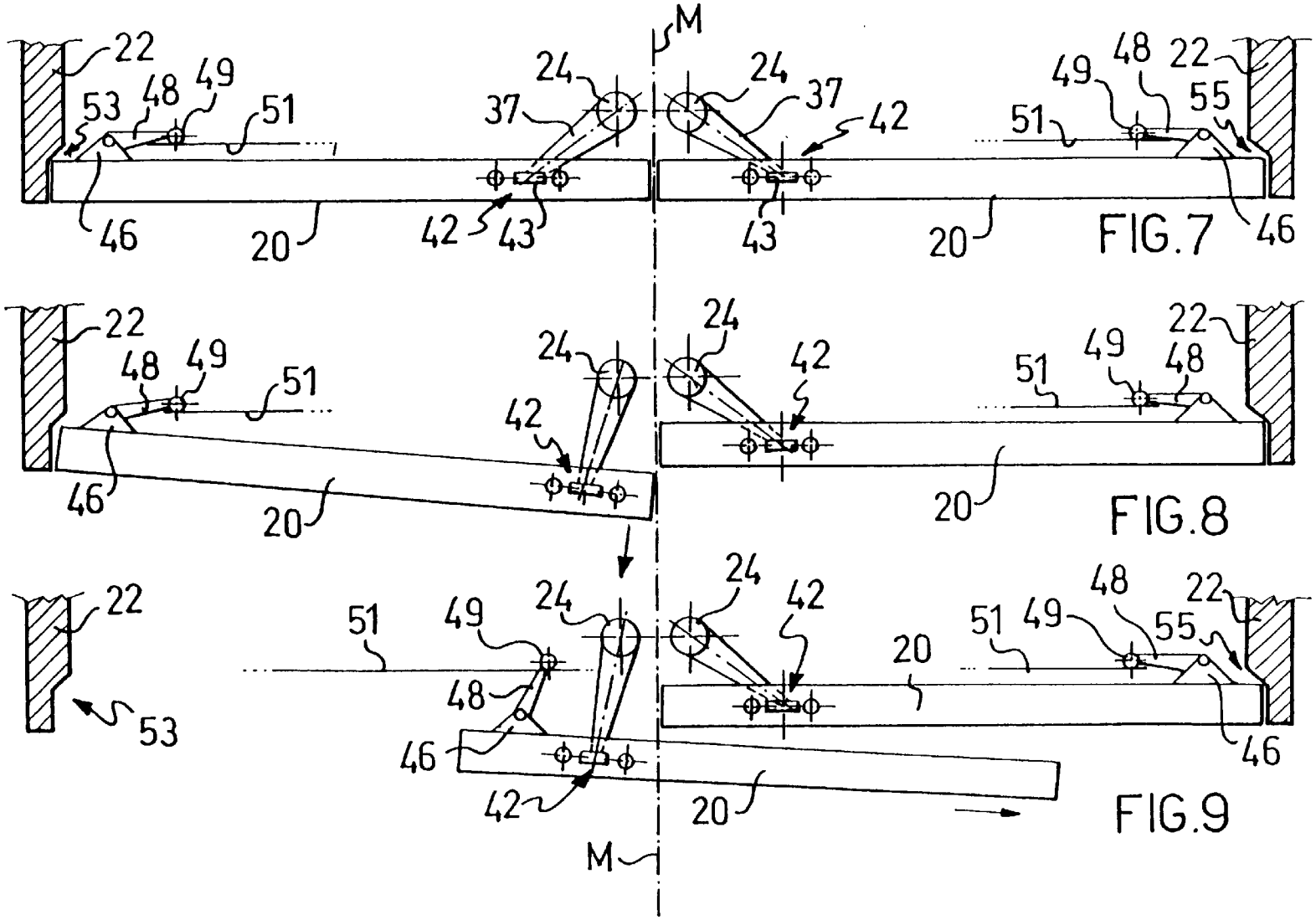
FIGS. 7, 8 and 9 show, from above, the movement of one of the two doors as it is opened.

One of the two doors 20 is gripped by its handle 61 and the abovementioned meeting side of the door is pulled outwards, moving it out of alignment with the other door, as illustrated in sequence in FIGS. 7 and 8. This movement is guided and constrained by the arms 36 and 37 which rotate together with the rod 24 about the axis X of the said rod.

With reference to FIG. 9, the door is then moved translationally, sliding it across on the wheels 52A, 52B and sliding the track 40 over the roller 39, the track 45 over the carriage 42 and the roller 49 along the track 51. This translational movement is continued until the displaced door stands in front of the other door. The door is opened in this way.

To close the door, the above procedure is reversed. As the door is closed, the mechanism formed by the arm 48, the roller 49 sliding along the track 51 and the spring 50 acts as a return mechanism bringing the opposite side of the door to the meeting side back into the indentation 53. Furthermore, this mechanism ensures that the entire opening and closing movement of the door runs smoothly and evenly.

When the door is in the closed position, the ball 59 drops into one of the two hollows 60, while when the door is in the position of maximum displacement outwards, the ball 59 drops into the other of the two hollows 60. The two positions are thus physically defined.

Figure 10:
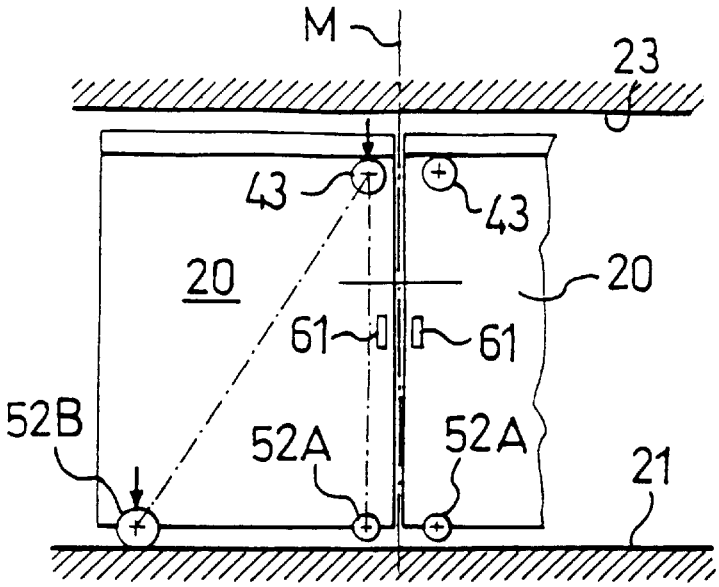
FIGS. 10, 11 and 12 show the abovementioned opening movement diagrammatically from the front.
Figure 11:
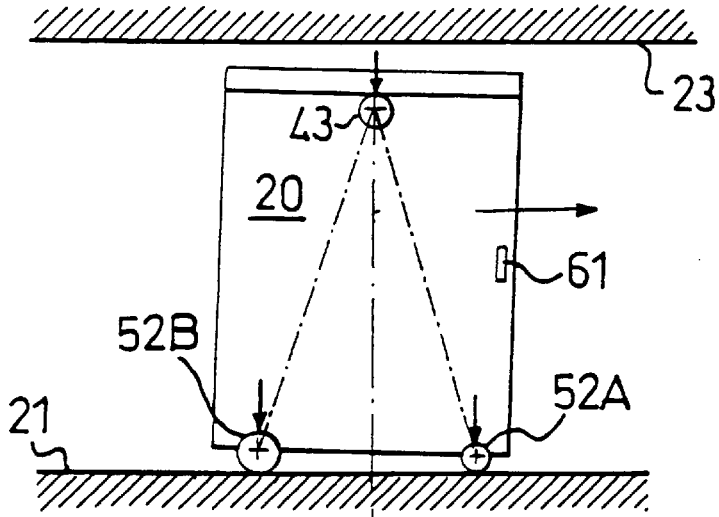
Figure 12:
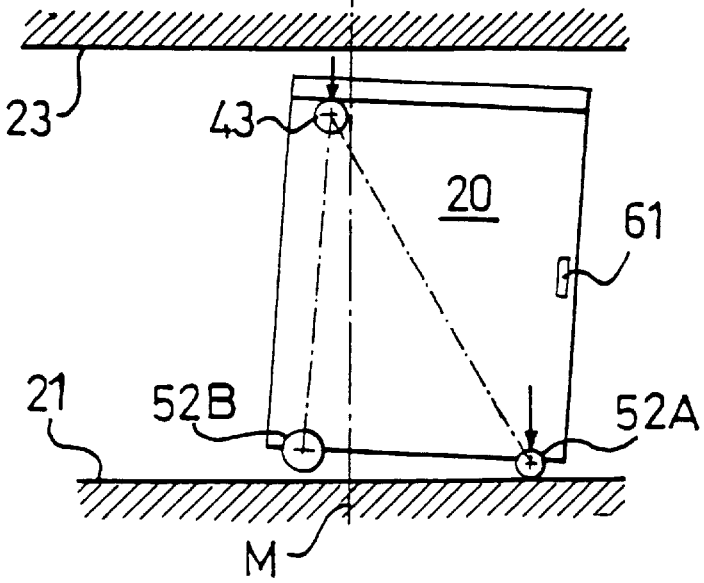

FIGS. 10, 11 and 12 show the distribution of the weight of the door as it is moved into the opened position. We should at this point state that the system is constructed such that the wheel 52A of the door closest to the meeting side does not rest on the bottom 21 of the wardrobe when the doors are in alignment; for this purpose the wheel 52A has a smaller diameter than the wheel 52B in the example illustrated. In this way, when the doors 20 are in the aligned position, as shown in FIG. 10, the weight of each door bears, at the top, on the wheel 43 of the carriage 42 and, at the bottom, on the wheel 52B. This arrangement facilitates the outward displacement of the door to be opened and prevents the wheel 52A from scraping along the bottom. As the door is then moved translationally in order to open it, there is a position in which the weight of the door will bear on both wheels 52A and 52B at the bottom as well as on the wheel 43 of the carriage 42 at the top, as indicated in FIG. 11. Continuing the translational movement, as shown in FIG. 12, the weight of the door will bear only on the wheel 52A at the bottom and on the wheel 43 of the carriage 42 at the top.

The door opening and closing system illustrated here has a number of advantages.

When in the closed position, the doors are in perfect alignment, making them aesthetically pleasing and extremely efficient at keeping out dust.

This system does not require any space in front of the doors in order to allow the latter to open and close, as is quite clear from looking at FIGS. 7, 8 and 9.

Moreover, given the few components required and the very basic movements involved, the above advantages are achieved using a system which is both structurally simple and easy to operate. Most importantly, this means that the system is extremely reliable. It also takes up very little space.

Naturally, it is possible to carry out modifications and/or additions to the system described and illustrated.

The system can also be applied to a single-door wardrobe or to one with more than two doors. The modifications which would have to be implemented will be evident to an expert in the field, since the mechanism for moving one door is basically independent of and identical to that for moving another door.

The system can be used in any type of furniture or in a room which is to be closed off or divided using one or more doors.

Needless to say, the above mentioned system components can be replaced by functionally equivalent components. For example, balls could be used instead of wheels and/or rollers. The tracks could have different shapes. The stop elements that define the aligned position of the doors or the elements that physically define the closed and outwardly displaced positions of the door could also be different. In order to keep the bottom wheel of the door closest to the meeting side raised in the closed position, it would also be possible to raise the carriage slightly, which would mean that the two bottom wheels could be of the same diameter.

We should, however, stress that the specific embodiment described and illustrated has proved particularly advantageous.

What is claimed is:

1. A system for opening and closing doors, in which there is at least one door that is moved between a closed position and an opened position, the system adapted to be installed in a structure having a top, a bottom and at least two side walls, the system comprising a fixed vertical rod rotatable about a vertical axis, and adapted to be disposed inside the structure, the vertical rod having opposite ends adapted to be rotatably engaged along the vertical axis of the rod at one end with the top of the structure and at the opposite end with the bottom of the structure, the vertical rod including rod arms extending therefrom that rotate about the vertical axis of the rod, the ends of the rod arms carrying elements that engage slidingly with horizontal tracks on the at least one door, wherein the bottom of the door has rolling elements adapted to make contact with the bottom of the structure, wherein, by rotating the arms, the at least one door can be moved from the closed position into a position in which it is displaced outwards and wherein the at least one door can be moved horizontally, and relative to the fixed vertical rod, by sliding the elements over the tracks and rolling the rolling elements along the bottom of the structure until the opened position is reached.

2. System according to claim 1, comprising an elastic return member that is attached to the at least one door and slides along a fixed horizontal track that is affixed to the ceiling of the structure, the elastic return member exerts an elastic return force on the at least one door to return it to the closed position.

3. System according to claim 2, wherein the elastic return means comprise a lever that is hinged to the top of the at least one door and carries a roller having a vertical axis, a spring acting on the lever, and wherein the fixed horizontal track is L-shaped and located on the ceiling of the structure, the spring pressing the roller elastically against the fixed track.

4. System according to claim 2, wherein stop elements are provided which define the closed position of the at least one door and at the bottom, a base fixed to the bottom of the structure, on which base the rod is rotatably mounted; at the sides, indentations in the side walls of the structure; and, at the top, the fixed track.

5. System according to claim 1, comprising stop elements that define the closed position of the at least one door.

6. System according to claim 5, wherein the stop elements comprise: at the bottom; a base fixed to the bottom of the structure, on which base the rod is rotatably mounted; and, at the sides, indentations in the side walls of the structure.

7. System according to claim 1, comprising physical reference means that define the closed position and an outwardly displaced position of the at least one door.

8. System according to claim 7, wherein the physical reference means comprise an elastic snap-engaging element that rotates with the rod and engages in one or other of two fixed reference hollows in order to define the closed and outwardly displaced positions.

9. System according to claim 1, wherein the rod is located close to one side of the at least one door and can rotate about its own vertical axis; wherein there are two rod arms, a lower rod arm and an upper rod arm, that are rigidly attached to the rod; wherein the engagement elements carried by the lower rod arm comprise a roller having a vertical axis, and the engagement elements carried by the upper rod arm comprise a carriage; wherein the tracks are U-shaped and parallel with each other; and wherein the rolling elements comprise first and second bottom wheels located symmetrically on either side of the vertical center line of the at least one door.

10. System according to claim 9, wherein the carriage is carried by the upper rod arm such that it can rotate freely and comprises a wheel having a horizontal axis and two rollers each having a vertical axis and located on either side of the wheel, the wheel and two rollers being orthogonal to one another, and wherein one of the tracks is in the shape of an inverted U and accommodates the wheel and the rollers of the carriage.

11. System according to claim 9, wherein, when the system is installed in the structure, in the closed position, the weight of the at least one door bears on the carriage and on the first bottom wheel on the side of the at least one door opposite the rod, the second bottom wheel having little or no weight bearing on it, and then, as the at least one door is moved into the opened position, the weight of the at least one door increasingly bears on the second bottom wheel as well as on the carriage, while the first bottom wheel has little or no weight bearing on it at all.

12. System according to claim 11, wherein the second bottom wheel has a smaller diameter than the first bottom wheel.

13. System according to claim 1, wherein there are at least two doors, each door having at least one vertical rod, and the two vertical rods connected to the two doors are located close to each other, symmetrically on either side of the vertical median joining plane of the two doors, the outwardly displaced position of the door being a position in which one door is out of alignment with the other door, and the opened position being a position in which the open door stands in front of the other door.

14. A door having a top and a bottom, horizontal tracks attached to the top and the bottom of the door, two rolling elements attached to the bottom of the door, and a fixed vertical rod, rotatable about a vertical axis, the rod displaced from the door and including an upper and lower arm extending therefrom, the lower arm including an engagement element that slidingly engages the horizontal track attached to the bottom of the door, and the upper arm including an engagement element that slidingly engages the horizontal track attached to the top of the door.

15. The door according to claim 14, having first and second sides defined by a center line, the rod being located on the second side of the door, wherein the engagement element that engages the horizontal track attached to the top of the door is a carriage, wherein the horizontal tracks are U-shaped and parallel to each other, and wherein the rolling elements comprise first and second bottom wheels that are disposed on the first and second sides of the at least one door, respectively.

16. The door according to claim 15, wherein when the door is disposed in a structure, the door can be moved between an opened position and a closed position, and wherein in the closed position, the weight of the door bears on the carriage and on the first bottom wheel, the second bottom wheel having little or no weight bearing on it, and, as the door is moved into the opened position, the weight of the door increasingly bears on the second bottom wheel as well as on the carriage, while the first bottom wheel has little or no weight bearing on it.

17. The door according to claim 16, wherein said first and second bottom wheels have different diameters.

18. The door according to claim 16, wherein said first and second bottom wheels have substantially the same diameter, and wherein said carriage is raised with respect to said door.

19. A method of opening a door that is installed in a structure and includes a fixed vertical rod rotatable about a vertical axis, the rod being displaced from the door and rotatable engaging the structure, the method comprising the steps of:

(a) placing the door in a closed position, wherein a first bottom wheel having a first circumference disposed adjacent a bottom corner of the door and a carriage disposed at a top of the door bear the weight of the door, and a second bottom wheel having a second circumference disposed adjacent a bottom corner opposite that of the first bottom wheel bears little to no weight of the door, wherein the first circumference is larger than the second circumference, (b) moving the door toward an open position, wherein the weight of the door increasingly bears on the second bottom wheel and the carriage because the first circumference is larger than the second circumference, and the door moves relative to the fixed vertical rod, and (c) placing the door in an opened position, wherein the second bottom wheel and the carriage bear the weight of the door, and the first bottom wheel bears little to no weight of the door.

20. A method of installing a door in a structure having a ceiling a bottom and a side wall, including the steps of:

(a) providing a door having a top and a bottom, horizontal tracks attached to the top and the bottom of the door, two rolling elements attached to the bottom of the door, and a fixed vertical rod rotatable about a vertical axis, the rod being displaced from the door and having upper and lower rod arms extending therefrom, the upper and lower rod arms each having an end that includes an element that is slidingly engaged with one of the horizontal tracks, (b) providing an indentation adapted to receive the door in the side wall, (c) providing an opening in the ceiling for receiving an end of the rod, and (d) installing the door, whereby a side of the door engages the indentation, the rod engages the opening and the rolling elements contact the bottom of the structure.

* * * * *